US006782555B1

(12) United States Patent
Yerelian

(10) Patent No.: US 6,782,555 B1
(45) Date of Patent: Aug. 31, 2004

(54) GLOVE USE WHILE EATING

(76) Inventor: Minas Yerelian, 4422 W. Slauson Ave., Los Angeles, CA (US) 90043

( * ) Notice: Subject to any disclaimer, the term of this patent is extended or adjusted under 35 U.S.C. 154(b) by 65 days.

(21) Appl. No.: 10/039,524

(22) Filed: Jan. 4, 2002

(51) Int. Cl.[7] ..... A41D 19/00
(52) U.S. Cl. ..... 2/160; 2/247
(58) Field of Search ..... 2/160, 161.6, 16, 2/20, 163, 164, 247; 15/227

(56) References Cited

U.S. PATENT DOCUMENTS

| | | | | | |
|---|---|---|---|---|---|
| 3,610,512 | A | * | 10/1971 | Hermalin | 229/117 |
| D258,625 | S | | 3/1981 | Sheridan | D2/365 |
| 4,938,515 | A | * | 7/1990 | Fazio | 294/25 |
| 5,149,159 | A | * | 9/1992 | Bardes | 294/1.3 |
| 5,518,169 | A | * | 5/1996 | Beales | 229/107 |
| 5,530,968 | A | | 7/1996 | Crockett | 2/46 |
| 5,878,438 | A | * | 3/1999 | Ragsdale | 2/158 |
| 5,987,645 | A | | 11/1999 | Teaster | 2/159 |
| 6,000,058 | A | * | 12/1999 | Iselin | 2/160 |
| 6,050,726 | A | | 4/2000 | Hoerl | 383/127 |
| 6,092,237 | A | | 7/2000 | Baldwin | 2/161.7 |
| 6,203,080 | B1 | | 3/2001 | Surplus | 294/1.3 |
| 6,249,917 | B1 | * | 6/2001 | Vrissimdjis et al. | 2/161.7 |
| 6,393,614 | B1 | * | 5/2002 | Eichelbaum | 2/160 |

* cited by examiner

*Primary Examiner*—Katherine Moran
(74) *Attorney, Agent, or Firm*—Goldstein Law Offices, PC

(57) ABSTRACT

A glove, for allowing convenient and mess-free eating when on the go, comprising a wrist portion, a palm portion, and a plurality of fingers. A pocket is attached to the fingers and has a top opening within which a food item may be placed. A user dons the glove by placing one hand into the glove. A food item is placed within the pocket and is partially exposed at the top opening of the pocket. The user may eat the food item while it remains in the pocket. After eating, the glove is grasped by the wrist portion and turned inside out in order to envelope the remaining food item and food debris.

7 Claims, 3 Drawing Sheets

GLOVE USE WHILE EATING

BACKGROUND OF THE INVENTION

The invention relates to a glove. More particularly, the invention relates to a glove that is worn by a person while eating a quick meal, such that the glove not only protects the wearer from soiling his hand, but also has provisions for holding the food being eaten.

Eating "on the go" has becomes necessary for many people whose busy schedules prohibit stopping for a meal. Such people are forced to eat while walking, riding a bus, and even driving. Because of the rushed nature of such meals, messes are frequent and often disastrous. The resulting crumbs, sauces and food dressings can easily soil not only the hands of the person, but their clothes as well. Commonly, the very people whose rushed schedule forces them to eat in this manner tend to be dressed in business attire.

Eating while driving creates its own special problems. When eating a fast food sandwich or the like, it is common to take a bite, and then put the sandwich down. Common practice is to open the fast food wrapper on the passenger seat, and use the wrapper as a temporary dish. However, a sharp turn or rapid deceleration can easily leave the fast food sandwich on the floor, or even on the seat itself!

U.S. Pat. No. 6,050,726 to Hoerl, discloses a glove bag, where a glove is attached to a bag, for allowing disposal of contaminated substances and the like. Hoerl is much too cumbersome to be used when eating on the go, and is particularly unsuitable for use while driving.

U.S. Pat. No. 6,092,237 to Baldwin discloses a drip catching glove. In particular, Baldwin has a cuff which seeks to prevent liquids which run down the glove from reaching the arm. However, Baldwin is only suitable for catching liquids which run down the glove. Baldwin would not catch falling sauces and dressings which drip from the sandwich but which do not run down the glove. Further Baldwin will not catch crumbs and falling food pieces.

While these units may be suitable for the particular purpose employed, or for general use, they would not be as suitable for the purposes of the present invention as disclosed hereafter.

SUMMARY OF THE INVENTION

It is an object of the invention to produce a glove which facilitates easy and mess-free eating while on the go. Accordingly, the glove extends over the hand of the user, and effectively protects the user's hand from becoming soiled.

It is another object of the invention to provide a glove which helps hold the food being eaten. Accordingly, the glove has a pocket proximal to the palm. The pocket allows a food item to be held and only partially exposed at the pocket opening, while freeing the fingers for other tasks. Accordingly, one could easily drive or perform other tasks while eating.

It is yet another object of the invention to provide a glove which catches falling crumbs, sauces, and other food debris. Accordingly, in addition to the pocket, a rigid skirt may extend laterally outward from the wrist area of the glove, in order to catch substances that fall during eating.

The invention is a glove, for allowing convenient and mess-free eating when on the go, comprising a wrist portion, a palm portion, and a plurality of fingers. A pocket is attached to the fingers and has a top opening within which a food item may be placed. A user dons the glove by placing one hand into the glove. A food item is placed within the pocket and is partially exposed at the top opening of the pocket. The user may eat the food item while it remains in the pocket. After eating, the glove is grasped by the wrist portion and turned inside out in order to envelope the remaining food item and food debris.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
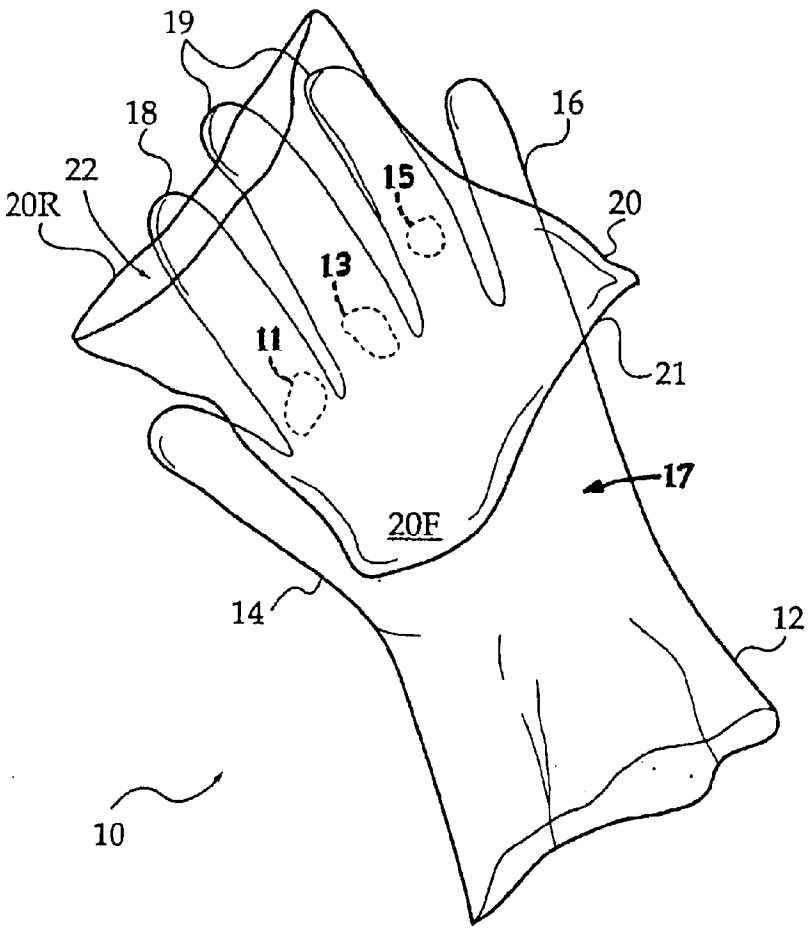
FIG. 1 is a diagrammatic perspective view, illustrating the invention, per se.

FIG. 1 illustrates a glove 10, comprising a wrist portion 12, a palm portion 14, and a finger portion 16. The finger portion 16 includes five fingers 18, including a thumb, index finger, middle finger, ring finger, and pinky finger. The fingers 18 have finger tips 19, fully opposite from the wrist portion 12. The wrist portion 12, palm portion 14, and finger portion 16 define a continuous interior 17.

According to the present invention, a pocket 20 is attached to the glove 10 to provide a convenient holding location while eating. In particular, the pocket 20 has a front panel 20F, a rear panel 20R, a bottom seam 21, and a top opening 22. The rear panel 20R extends across the palm portion 14 and finger portion 16, with top opening 22 located near the fingertips 19, extending across several of the fingers 18 immediately below the fingertips 19. The bottom seam 21 extends across the palm portion 14. The rear panel 20R is attached to at least two of the fingers 18, and is preferably attached to the index, middle, and ring fingers at points 11, 13, and 15 respectively. Points 11, 13, and 15 are represented by hidden lines to indicate that they are shielded from frontal view.

Figure 2:
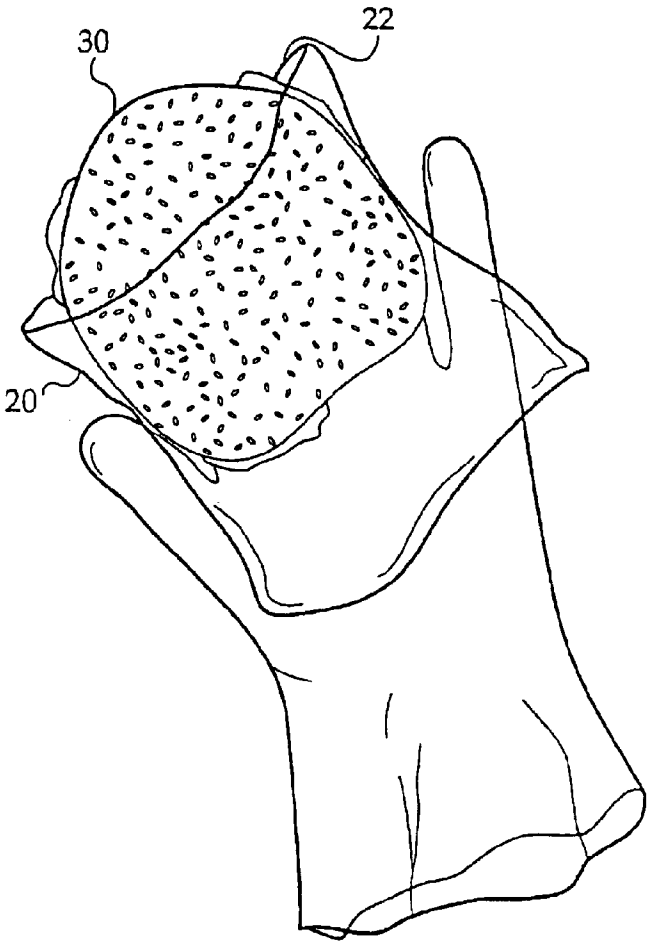
FIG. 2 is a diagrammatic perspective view, illustrating the invention in use, holding a food item—namely a hamburger bun.

In FIG. 2, a food item 30, which is illustrated as a hamburger bun, is located within the pocket 20. The food item 30 is partially exposed at the top opening 22 with the remainder of the food item 30 being enclosed within the pocket 20. Accordingly, the food item 30 is securely maintained within the pocket 20, but is instantly available to "take a bite" when desired.

Figure 3:
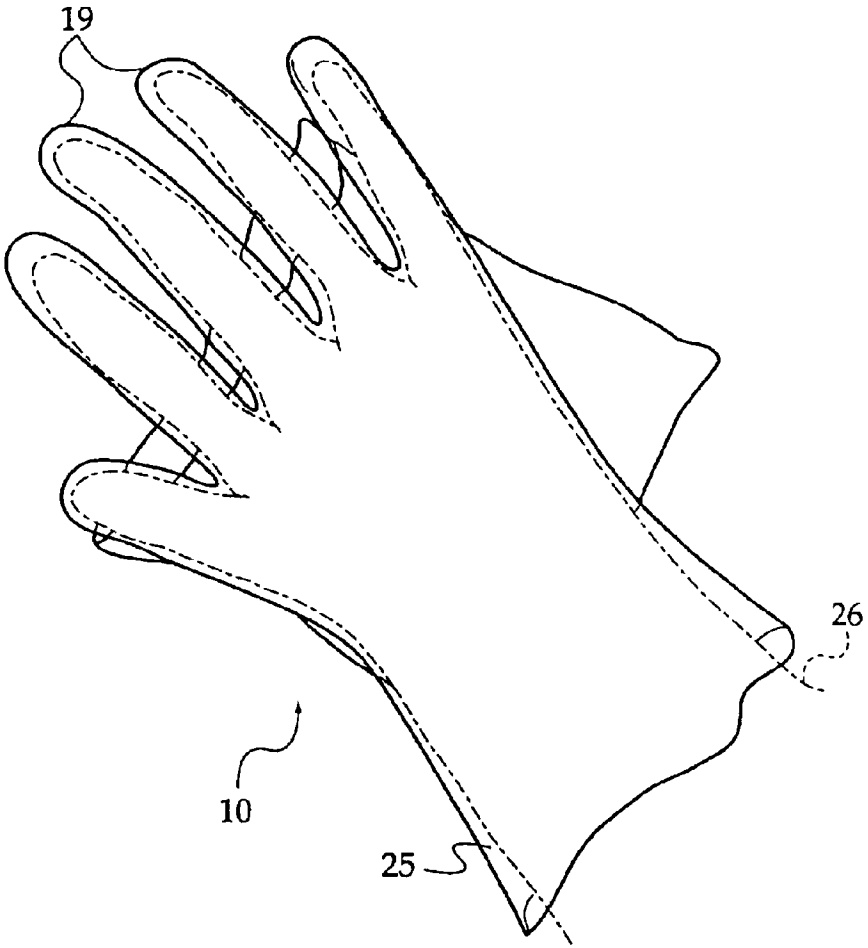
FIG. 3 diagrammatic perspective view, illustrating the invention in use, wherein a hand is extending within the glove.

In FIG. 3, a back side 25 of the glove 10 is seen. In addition, a human hand 26 is fully extended into the glove 10 to the fingertips 19 of said glove 10.

Referring to the drawing figures in general, when food is within the pocket 20, it can be grasped by the hand as well. Accordingly, the pocket 20 provides two layers between the hand and the food item 30, and contains the food item 30, collecting crumbs and food debris, as only a small portion of the food item 30 needs to be exposed at the top opening 22 in order to "take a bite". Thus, when in the pocket 20, the food item is partially exposed, while the remainder of the food item remains within the pocket.

Figure 4:
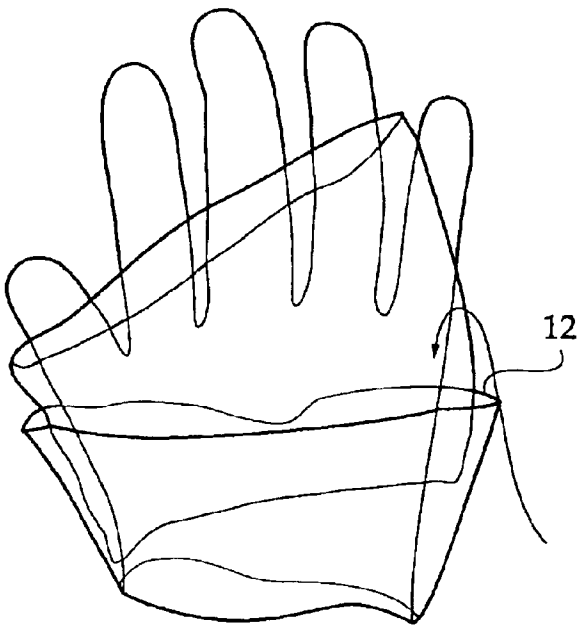
FIG. 4 is a diagrammatic perspective view, illustrating the glove being removed after eating, wherein the glove is grasped by the wrist portion and turned inside out—enveloping the remainder of the glove trapping any food debris therein.

FIG. 4 illustrates how, after the user finishes eating, the glove 10 is grasped by the wrist portion 12 and is removed from the hand by turning the glove inside out, enveloping the rest of the glove. While doing so, any food debris or mess present on the glove is engulfed by the glove, and may be disposed of with the glove.

Figure 5:
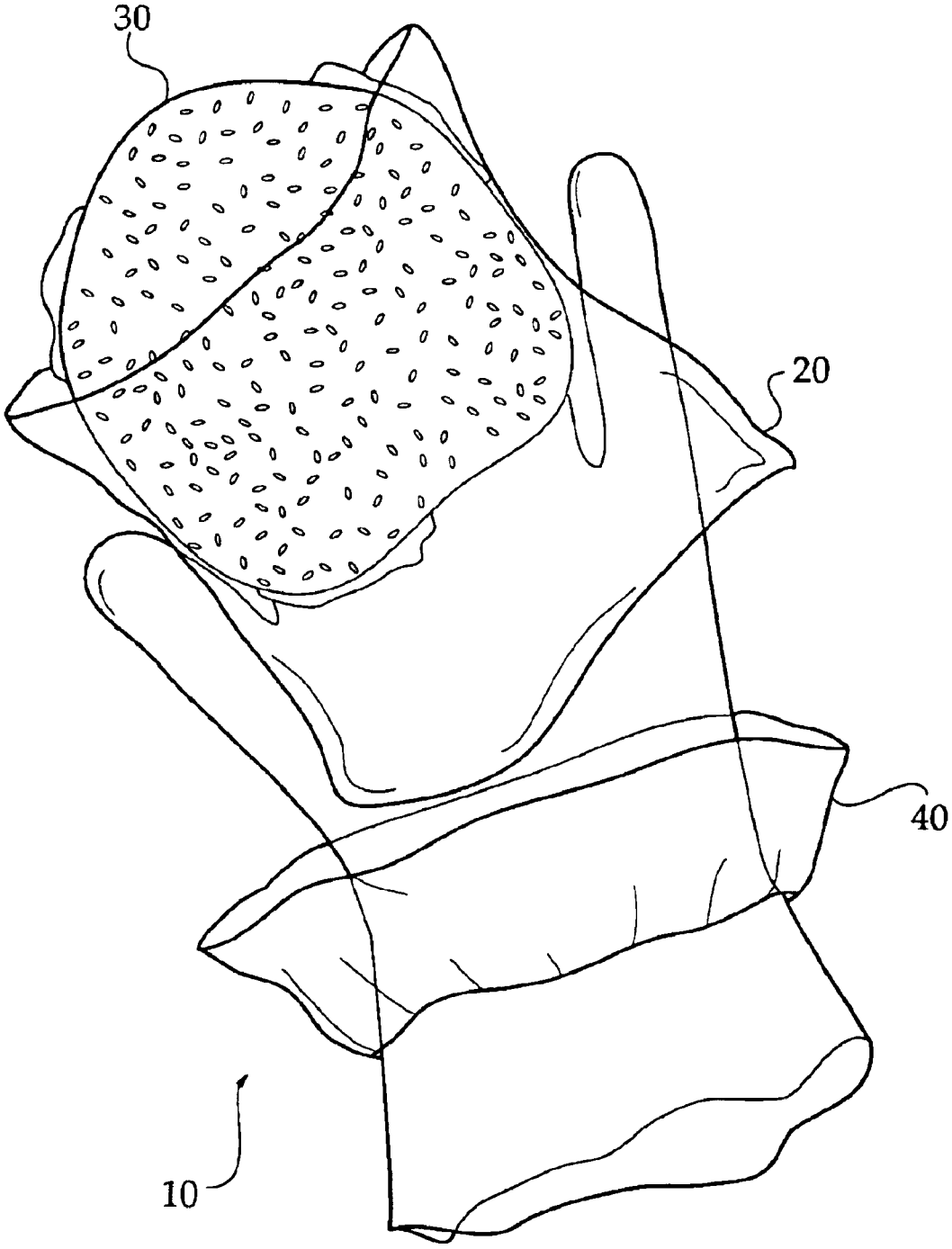
FIG. 5 is a diagrammatic perspective view of an alternate embodiment of the invention in use.

FIG. 5 illustrates an alternate embodiment of the glove, wherein a skirt 40 extends circumferentially around the wrist portion 12 below the pocket 20. The skirt 40 extends laterally outward therefrom. Further, the skirt 40 is most effective if it is rigid, made of cardboard or the like, so that it can extend laterally outward for a significant distance without collapsing under the weight of food debris. The skirt 40 helps catch falling food debris while eating the food item 30. After eating, when the glove 10 is turned inside out for disposal, the skirt 40 is also engulfed therein.

In conclusion, herein is presented a glove which facilitates convenient and mess-free eating while on the go. The invention is illustrated by example within the accompanying drawings figures and in the foregoing description. Numerous variations are possible, while adhering to the inventive concept. Such variations are contemplated as being a part of the present invention.

What is claimed is:

1. A glove for use while eating, comprising:

a wrist portion;

a palm portion;

a finger portion, having a plurality of fingers, wherein each of the fingers has a finger tip that is opposite from the wrist portion, and wherein the wrist portion, palm portion, and finger portion together create a continuous interior which accommodates a human hand that extends to the finger tips; and a pocket having a front panel, a rear panel, a bottom seam and a top opening, wherein the rear panel attaches to the fingers and extends across the palm portion, the bottom seam extends across the palm portion and the top opening extends across the finger tips, and wherein the pocket accommodates a food item which is partially exposed at the top opening.

2. The glove as recited in claim 1, wherein the top opening extends immediately below at least two of the finger tips.

3. The glove as recited in claim 2, wherein the finger portion has five fingers.

4. The glove as recited in claim 3, further comprising a skirt that circumferentially extends around the wrist portion below the pocket and catches any falling food debris.

5. A method of eating a food item using the glove as recited in claim 4, comprising the steps of:

inserting the hand into the glove and extending it up to the finger tips;

placing the food item inside the pocket;

grasping the food item with the hand while it remains inside the pocket;

exposing a portion of the food item at the top opening; and eating a portion of the food item while the uneaten portion of the food item remains inside the pocket.

6. The method of eating a food item as recited in claim 5, wherein the step of eating a portion of the food item is followed by a step of removing the glove from the hand by grasping the wrist portion and turning the glove inside out to envelop the pocket and any uneaten food item contained therein.

7. The method of eating a food item as recited in claim 6, wherein the step of eating a portion of the food item further comprises the step of utilizing the skirt to catch any falling food debris.

* * * * *